United States Patent [19]

Flämig

[11] Patent Number: 4,984,896

[45] Date of Patent: Jan. 15, 1991

[54] METHOD AND APPARATUS FOR OPTICALLY MONITORING A KNITTED ARTICLE

[75] Inventor: Peter Flämig, Grosskarolinenfeld, Fed. Rep. of Germany

[73] Assignee: Protechna Herbst Gmbh & Co. K.G., Ottobrunn, Fed. Rep. of Germany

[21] Appl. No.: 253,713

[22] Filed: Oct. 5, 1988

[30] Foreign Application Priority Data

Oct. 6, 1987 [DE] Fed. Rep. of Germany ..... 3733791

[51] Int. Cl.[5] ..... G01N 21/84; G01N 21/86; D04B 35/12

[52] U.S. Cl. ..... 356/429; 250/559; 250/563; 66/163

[58] Field of Search ..... 356/429–431, 356/448; 250/559, 563, 571, 572, 562; 66/152, 158, 163

[56] References Cited

U.S. PATENT DOCUMENTS

| | | | |
|---|---|---|---|
| 3,474,254 | 10/1969 | Piepenbrink et al. | 356/430 |
| 4,124,300 | 11/1978 | Mead et al. | 356/429 |
| 4,166,541 | 9/1979 | Smith, Jr. | 356/431 |
| 4,549,413 | 10/1985 | Flämig | 250/559 |
| 4,748,334 | 5/1988 | Kobayashi et al. | 356/431 |
| 4,845,374 | 7/1989 | White et al. | 356/448 |

FOREIGN PATENT DOCUMENTS

| | | |
|---|---|---|
| 3536991 | 1/1987 | Fed. Rep. of Germany . |
| 2180929 | 4/1987 | Fed. Rep. of Germany . |
| 3534019 | 4/1987 | Fed. Rep. of Germany . |
| 2181834 | 4/1987 | United Kingdom . |

OTHER PUBLICATIONS

Operating Instructions for KW Warp Knitting Machine Monitors by Erwin Sick GmbH Optic, Electronik.

*Primary Examiner*—Richard A. Rosenberger
*Assistant Examiner*—Hoa Pham
*Attorney, Agent, or Firm*—Hoffmann & Baron

[57] ABSTRACT

For optical monitoring of a knitted article for faults during the manufacture thereof in a knitwear processing machine, the knitted article is scanned line by line by the optical scanner. The scan signals generated in the process are delivered to a digital processing circuit. In a reference mode, the scan signals are stored as pattern signals in the digital processing circuit. In a subsequent operating mode during manufacture of the knitted article, the scan signals are compared as operating scan signals with the pattern signals corresponding to the scan position, to check if they match. If they do not match, a fault signal is generated.

20 Claims, 6 Drawing Sheets

Fig. 8
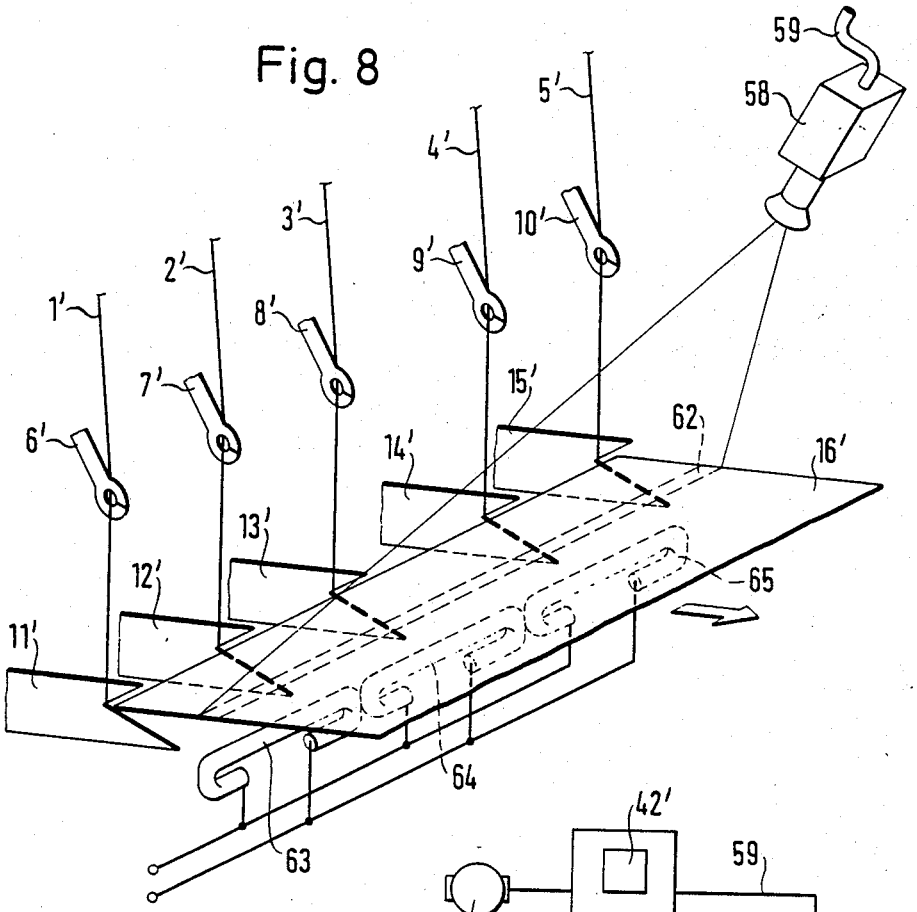
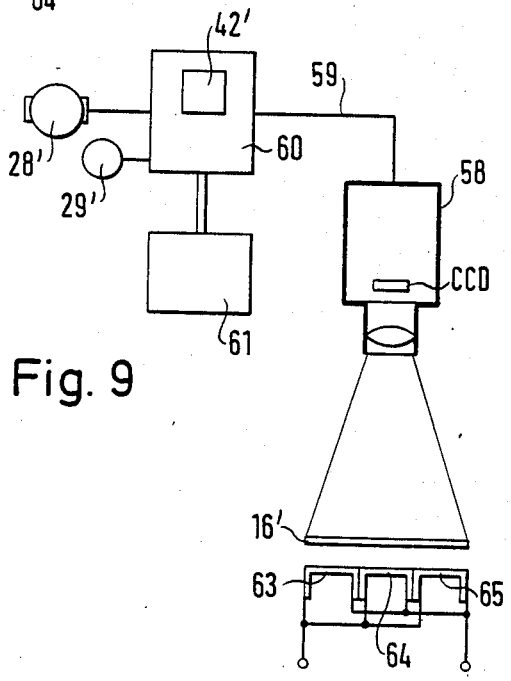
Fig. 9

METHOD AND APPARATUS FOR OPTICALLY MONITORING A KNITTED ARTICLE

BACKGROUND OF THE INVENTION

1. Field of the Invention

The invention concerns a method and an apparatus for optically monitoring of a knitted article during the manufacture thereof in a knitwear processing machine for faults, wherein an optical scanner scans the width of the knitted article perpendicularly to the direction of take-off and, on detection of a fault in the knitted article, indicates this and/or stops the knitwear processing machine.

2. Description of Related Art

Warp knitting machine monitors for warp knitting machines, particularly for elastic and outer garment double rib looms and terry towelling warp knitting machines, are known from the operating instructions for KW warp knitting machine monitors by the firm Erwin Sick GmbH Optik, Elektronik. These warp knitting machine monitors are used to monitor almost flat, plain-coloured knitted goods. These known warp knitting machine monitors comprise a guide rail which is disposed above the knitted article perpendicularly to its direction of travel. On the guide rail is a longitudinally movable carriage provided with a rod-like holder, at the free end of which is provided a reflex photocell head which is positioned close above the knitted article. Inside the carriage are provided electronic circuit components connected to the reflex photocell which consists of a light transmitter and a light detector. The carriage comprises a current collector connection to electrical conductors of the guide rail. The knitted article is gripped by so-called temples which are used to take off the fabric in the direction of take-off. A reflex photocell of this kind, guided by the guide rail, is moved perpendicularly to the direction of take-off of the knitted article In case of faults due to threads in the knitted article (finished article), the altered reflex behaviour is detected electrically and analysed accordingly Of course, the known warp knitting machine monitor has the advantage that the reflex photocell is disposed close above the finished knitted article in the region of the knitting tools. But it is a disadvantage that the reflex photocell cannot be moved as far as the edge of the finished article or beyond the edge of the article, as this warp knitting machine monitor is elaborate and unfavourable in its dimensions and its arrangement. Another disadvantage can be seen in that the current collector on the photocell carriage is sensitive to soiling and corrosion. Furthermore it is a disadvantage that the holder located between the reflex photocell and the photocell carriage is moved through the working zone of the knitter. It is also a disadvantage that the reflex photocell cannot be moved directly between the knitwear temple and the warp knitting tools, so that complete scanning of the knitted article is not guaranteed. It is also a disadvantage that a patterned or discontinuous knitted article cannot be monitored by means of the known warp knitting machine monitor.

From West German patent application No. 35 34 019 is known an optical web monitoring device which comprises a lighting arrangement which projects the pupil of the lighting system with a concave reflector strip into the viewing pupil of an objective lens of a diode line scan camera, in order thus to obtain the maximum possible luminous efficacy At the same time as monitoring the fabric, a fault finder with laser scanner is operated, the same reflector strips being used. This optical web monitoring device is of course used to check webs of material in which no mechanically rapidly moving optical components are to be used. The light radiated by light sources and reflected by the webs of material is to be detected by a photocell assembly with the minimum possible losses. The transmitting concave reflector which is used is dimensioned such that the light strip produced on the web of material in fact extends across the full width of the web of material. The light strip on the surface of the web of material is projected in greatly reduced form on the diode line which is provided inside the photographic camera. To produce sufficient light intensity for the diode line, the entrance pupil is projected into the lens.

This known optical web monitoring device, which is concerned mainly with projection matters and increasing efficiency of light intensity at the photocell assembly, indicates no possible solution for detecting knitwear faults due to threads in discontinuous or patterned knitwear as well. Also the optical web monitoring device is not suitable for this kind of fault detection as a result of its elaborate structure for on-line knitwear fault detection in the region of the knitting tools.

SUMMARY OF THE INVENTION

It is therefore the object of the invention to provide a method and an apparatus for optically monitoring a knitted article during manufacture thereof of the kind mentioned hereinbefore, to allow satisfactory detection of knitwear faults due to threads easily and reliably for discontinuous and/or patterned knitted goods as well.

According to the invention, the object is achieved by the fact that:

the optical scanner scans the knitted article line by line and delivers the resulting scan signals to a digital processing circuit, in a reference mode the scan signals are stored in the digital processing circuit as pattern signals, and in a subsequent operating mode during manufacture of the knitted article the scan signals are compared as operating scan signals with the pattern signals corresponding to the scan position to check if they match, and if they do not match a fault signal is transmitted.

Due to the fact that in a reference mode the knitted article is scanned across its full width and these scan signals are stored in the digital processing circuit, there is the advantage that these digital scan signals or pattern signals are available as reference signals. In the subsequent operating mode, in each case depending on the position of scanning, corresponding operating scan signals are compared with the associated reference signals for the same scan position. In this way, a knitted article with any pattern and/or a discontinuous knitted article can be checked for faults due to threads. When, with respect to a scan position of the finished knitted article, inequality is detected between the associated pattern signal and the operating scan signal, this is a clear, unambiguous indication of a fault of this kind.

According to a further development, a fault signal is transmitted only if, after a given number of successive line scans, inequality is detected respectively for the same position in the line. If therefore, during a process of comparing a scanning line, inequality is detected at one or more points, this does not yet result in fault signalling. Not until the given number of successive inequality signals is generated for the same line position, is a fault signal generated and/or the knitwear processing machine is stopped.

According to a further development, after detection of a fault, stopping of the knitwear processing machine, rectification of the fault and after switching the knitwear processing machine on again, rescanning or recomparison processes are commenced after a given time lag after which the fault zone of the knitted article has definitely moved out of range of the scanner. In this way it is ensured that during rescanning and recomparison no additional fault signal is generated for the faulty area of the knitted article which has already been analysed.

According to a further development, in the reference mode several lines of the knitted article are scanned, wherein the means of corresponding pattern signals of a scan position of several lines is taken, as seen in the take-off direction of the knitted article.

The object according to the invention is also achieved by an optical monitoring device for a knitwear processing machine with an optical reflex scanner which is movable across the web of knitwear perpendicularly to the direction of take-off of the knitted article, wherein the reflex scanner comprises a light source and a light detector, by the fact that the light source and the light detector are arranged at the respective ends of a light shaft which is provided parallel to the plane of the knitted article and whose length is at least equal to the width of the knitted article, wherein in a scanning carriage movable along the light shaft is disposed, in the path of the beam, a 90° corner reflector whose bisecting line formed by the two partial reflectors runs parallel to the path of the beam, and wherein the first partial reflector facing towards the light source is fully reflective, while the second partial reflector facing towards the light detector is semitransparent, so that the transmitted light rays pass through the second partial reflector and the light rays reflected by the knitted article are deflected to the light detector.

This yields the advantage that scanning of the knitted article in the immediate region of the knitting tools across the full width of the knitted article is possible. Another advantage can be seen in that there are no current collectors on the scanning carriage, as the light transmitter and light detector are mounted stationarily on the respective ends of the light shaft. The light rays emanating from the light transmitter are deflected by the 90° corner reflector onto the knitted article.

The light beam which is reflected there is deflected by the partially transparent reflector of the 90° corner reflector to the light detector. If the light source has appropriate dimensions, the light shaft and hence the scanning carriage can be arranged correspondingly far above the web of material. In this way the reflector carriage can be moved to beyond the edge region of the knitted article, which yields the advantage that the edge of the knitted article can be detected. It is also an advantage that the reflex light beam with correspondingly high concentration can be guided in the region between the so-called temple for the knitted article and the knitting tools. Changes in intensity due to distance on the photocell of the photocell assembly, which occur on account of the varying position of the scanning carriage, have no effect in the comparison process. Tilting of the 90° reflector assembly does not alter the direction of incidence of the detected light beam.

According to a further development, a semiconductor laser with a collimator lens is used as the light source.

Advantageously, the light detector consists of two or more photocells which are arranged vertically one above the other with respect to the plane of the knitted article.

Also, according to a further development in the region of the edge of the 90° corner reflector on the side facing towards the light detector is provided a lens assembly. The focal length of this lens assembly is equal to or more than the distance between the 90° corner reflector and knitted article. In this way the size of the image of the knitted article on the light detector is maintained more or less constant, regardless of where the scanning carriage with the 90° corner reflector assembly is located. Another advantage of the 90° corner reflector lies in that the detector beam reaching the light detector does not leave the photocell assembly if the scanning carriage tilts, but keeps its alignment. This yields the advantage that particularly wide knitted articles can be monitored for faults too.

According to a further development an angle pick-up is provided which, during movement of the scanning carriage, emits position signals which signal the position of the scanning carriage.

In an advantageous development a pair of photocells is used, one photocell of which is connected to a regulating circuit for regulating the laser output of the semiconductor laser.

If more than two photocells are used, a higher and more satisfactory definition can be obtained as a result. In this case, difference signals from signals of adjacent photocells are integrated in an integrator circuit.

It is also conceivable that not only one photocell of the pair of photocells is used for analysing the line scans, but also the photocell which serves to regulate the laser beam output. By comparing the signals of the two photocells of the pair, the fault signal can be increased accordingly, which has the advantage that even weak fault signals result in corresponding amplification. If the photocells are increased, by accumulation there is obtained a corresponding increase in the signal.

In an advantageous embodiment, the light detector is connected by an analog-to-digital converter to a digital processing circuit comprising a control circuit and a random access memory, wherein the digital processing circuit comprises a mode selector for selecting a reference mode and an operating mode, the random access memory being switched to reading in the operating mode.

According to a further development, the digital processing circuit comprises a microcomputer which, apart from the analog-to-digital converter of the light detector, is connected to the angle pick-up (coder) and a motor control means, wherein the pattern data can be written in the memory only in the reference mode.

The object according to the invention is also achieved by an optical monitoring device for a knitwear processing machine with a light source and a light detector and with a processing circuit, by the fact that beneath the knitted article is provided a light source assembly extending across the full width, and above the knitted article is provided a camera covering its full width with a digital image converter device (CCD) connected to a digital processing circuit comprising a microcomputer, wherein a mode stage is provided by which the digital processing circuit can be switched to the reference mode or operating mode in which the actual operating scan data as control point data in the digital processing circuit are compared line by line with the reference data read from a memory of the digital processing circuit. Such an optical monitoring device is distinguished by its particular speed in line scanning, no mechanically moving parts being involved. This optical monitoring device is particularly suited to discontinuous or patterned knitwear which may have not only longitudinal stripes, but also any pattern, and is also advantageous due to its speed.

The optical monitoring device is arranged in such a way that the knitted article is scanned in the immediate vicinity of the knitting tools and beyond the side edge. By synchronous comparison of the actual scan signals with the pattern signals or reference signals, only the differences in signals in relation to the same scan position of a scanning line are detected. Signal variations in the intensity of the light source, particularly the semiconductor laser assembly, do not enter into the result of the comparison.

BRIEF DESCRIPTION OF THE DRAWINGS

The invention is described below with reference to two practical examples shown in FIGS. 1 to 9. These show:

FIG. 8 another practical example with a CCD camera in a warp knitting machine;

FIG. 9 a schematic circuit diagram of this practical example; and

DESCRIPTION OF THE PREFERRED EMBODIMENTS

Figure 1:
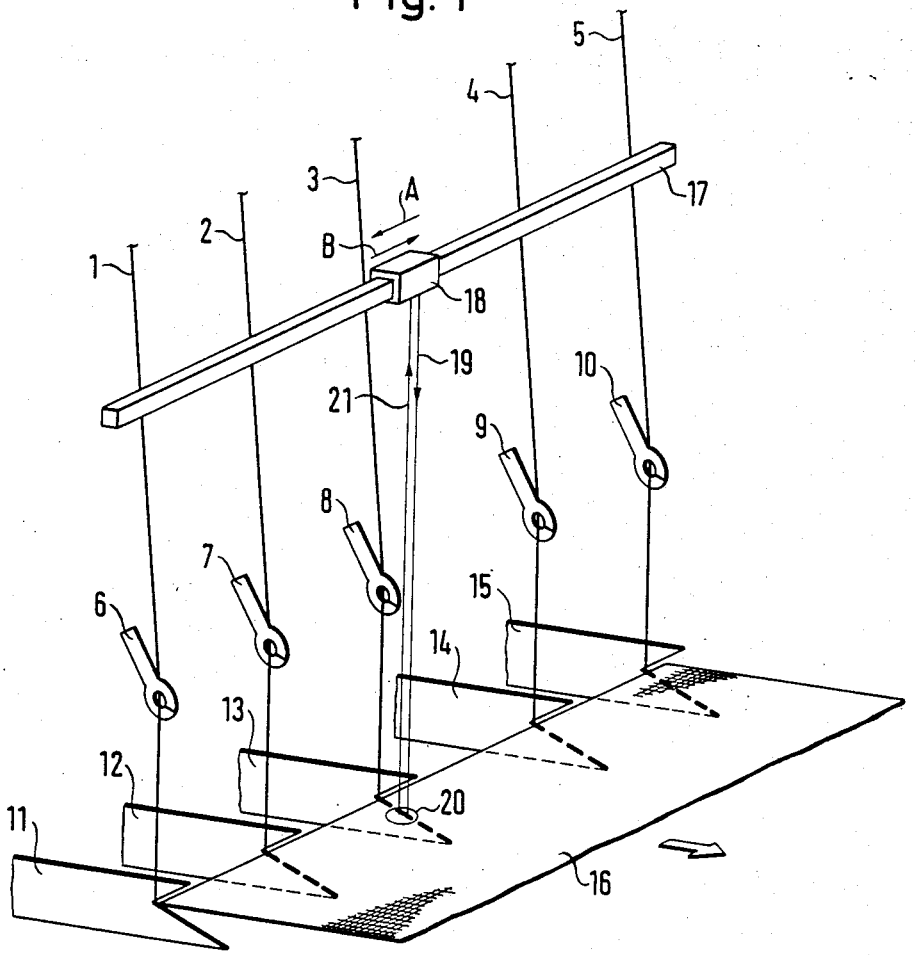
FIG. 1 a schematic view of an optical monitoring device in a warp knitting machine.

According to FIG. 1, warp threads of a warp knitting machine are marked 1, 2, 3, 4 and 5 and pass through needles with eyes 6, 7, 8, 9 and 10. Sinkers are marked 11, 12, 13, 14 and 15. The flat or finished knitted article bears the reference number 16. 17 denotes a guide rail for a scanning carriage 18 which can be moved by a motor along the guide rail in a manner not shown. Movement is either in direction A or B. The guide rail 17 is simultaneously designed as a light shaft in which, in a manner not shown, are disposed a light source and a light detector, one at each end. 19 denotes the light beam which emanates from the scanning carriage 18 and which impinges on the finished knitted article with a small diameter and there produces a light spot 20. The incoming light beam 19 is reflected by the knitted article, and passes as a reflected beam 21 back into the scanning carriage 18.

Figure 2:
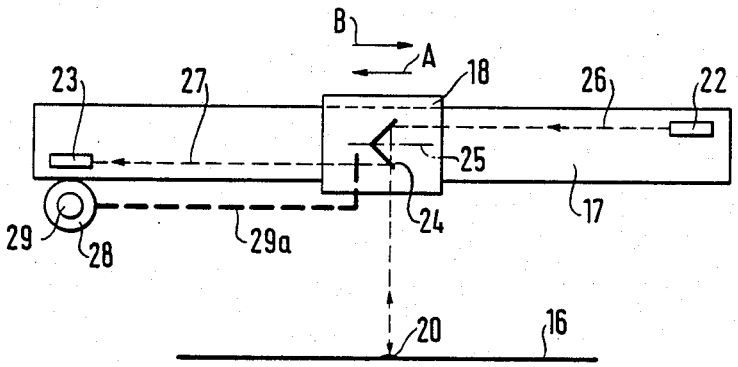
FIG. 2 a schematic view of a scanning carriage of the optical monitoring device.

According to FIG. 2, a semiconductor laser 22 is located in the light shaft 17 as the light source. As a light detector there is used a photocell 23 which is offset from the semiconductor laser 22 in relation to the plane of the knitted article 16. In the scanning carriage 18, there is located a 90° corner reflector 24 which is arranged in such a way that its bisecting line 25 is parallel to the light beam 26 of the semiconductor laser 22 or parallel to the plane of the knitted article 16. The transmitted light beam 26 is deflected downwards by the 90° corner reflector onto the knitted article, and after reflection at the knitted article again impinges on the 90° corner reflector, in order then to impinge as the detected light beam 27 on the photocell 23. 28 denotes a drive motor by which the corner reflector carriage 18 can be moved in the direction of arrow A or B by means of a gear connection 29. **29*a* denotes an angle pick-up which during movement of the scanning carriage 18** transmits position pulses for signalling the position of the scanning carriage.

Figure 3:
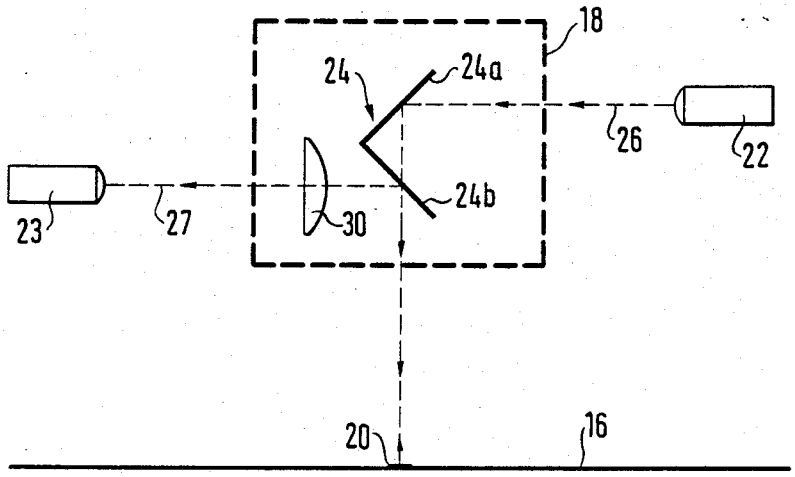
FIG. 3 a schematic view of a 90° corner reflector.

According to FIG. 3, in which the components corresponding to the components of FIG. 2 are provided with the same reference numbers, a convex lens 30 is disposed in the scanning carriage 18 adjacent to the 90° corner reflector 24 on the side facing towards the photocell 23, in the region of the pivot point of the 90° corner reflector 24. The upper partial reflector **24*a* of the 90° corner reflector is fully reflective while the lower partial reflector 24*b* is semitransparent. This means that the transmitted light beam 26 is fully reflected at partial reflector 24*a*, in order then to pass through semitransparent partial reflector 24*b* onto the knitted article 16. After reflection of the light beam at the knitted article 16, the light beam at the semitransparent partial reflector 24*b* is deflected through 90° and passes through the convex lens 30 as the detected light beam to the photocell 23. The focal length of the convex lens 30 roughly corresponds to the distance between the 90° corner reflector and the knitted article 16. The convex lens 30 which moves with the scanning carriage 18 to a certain extent acts as a second detector lens, yielding the advantage that the size of the image of a fault on the photocell is almost independent of the position of the scanning carriage. This means that, particularly with wide knitted articles, slight tilting of the scanning carriage 18 may occur, in which the bisecting line of the 90° corner reflector no longer runs parallel to the transmitted light beam or the plane of the knitted article. The 90° corner reflector compensates for tilting of this kind, while the convex lens 30** prevents the detected light beam from drifting (parallel displacement of the detected light rays and zoom effect) out of the receiving surface of the photocell.

Figure 4:
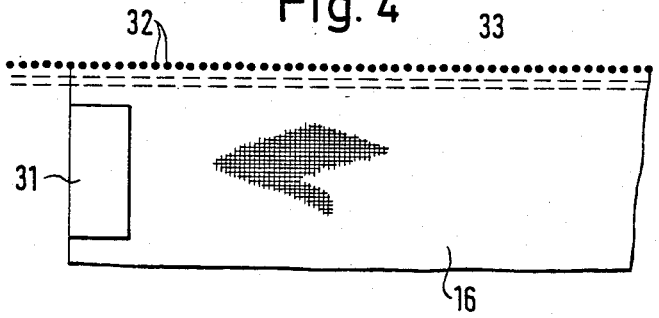
FIG. 4 a partial view of a warp knitting machine from above with the position of a scanning line.

According to FIG. 4, a plan view of part of the warp knitting machine shows the finished knitted article 16 which is gripped by a temple 31. 32 denotes the individual warp threads and needles. 33 denotes the scanning path of the scanning light beam. It extends between the row of needles 32 and the temple 31. This gives rise to the advantage of monitoring the knitted article 16 in the immediate region of the row of needles 32, i.e. immediately where the knitted article is formed. In this way, faults due to warp threads are detected immediately.

Figure 5:
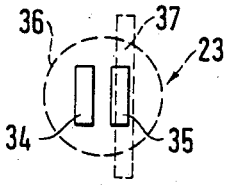
FIG. 5 a pair of photocells with a fault in a knitted article projected onto them.

According to FIG. 5, the photocell assembly consists of a split photocell diode whose individual diodes are marked 34 and 35. 36 denotes the image of the light spot 20 on the photocell 23. 37 denotes the size of a fault in the knitted article which, according to FIG. 5, is just being projected onto the photocell 35. This image of the fault 37 travels from photodiode 35 to photodiode 34 during movement of the scanning carriage 18.

Figure 6:
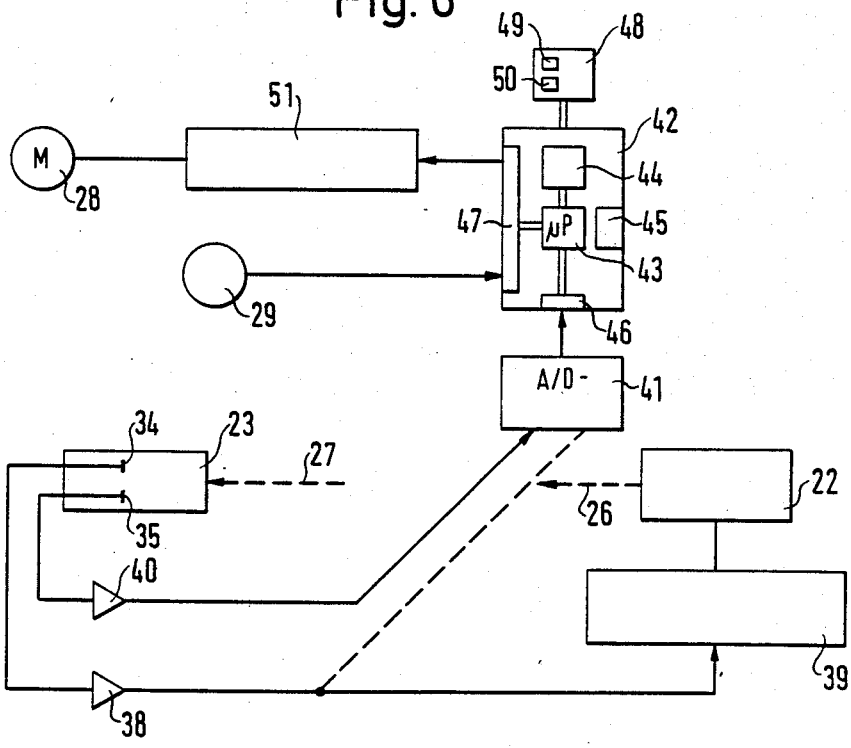
FIG. 6 a schematic circuit of the optical monitoring device.

In FIG. 6, the components corresponding to the components of the preceding figure are provided with the same reference numbers. The first photodiode 34 is connected by an amplifier 38 to a regulating circuit 39 for regulating the laser output of the semiconductor laser 22.

The second photodiode 35 is connected by an amplifier 40 to an analog-to-digital converter 41 whose output is connected to a microcomputer 42.

The microcomputer contains a microprocessor 43, a program register 44, a main memory, not shown, and a random access memory 45. A first interface circuit is marked 46, while a second interface circuit bears the reference number 47. By means of a mode circuit 48, the mode of the microcomputer 42 can be controlled by pushbutton switches 49 and 50.

The interface circuit 47 comprises on the one hand a connection to the angle coder 29 and on the other hand a control connection to a motor control stage 51 whose output is connected to the drive motor 28.

By means of a gear connection, particularly a closed toothed belt, the motor 28 moves the scanning carriage 18, wherein in dependence on movement, position signals are delivered by the angle coder 29 to the microcomputer 42.

Figure 7:
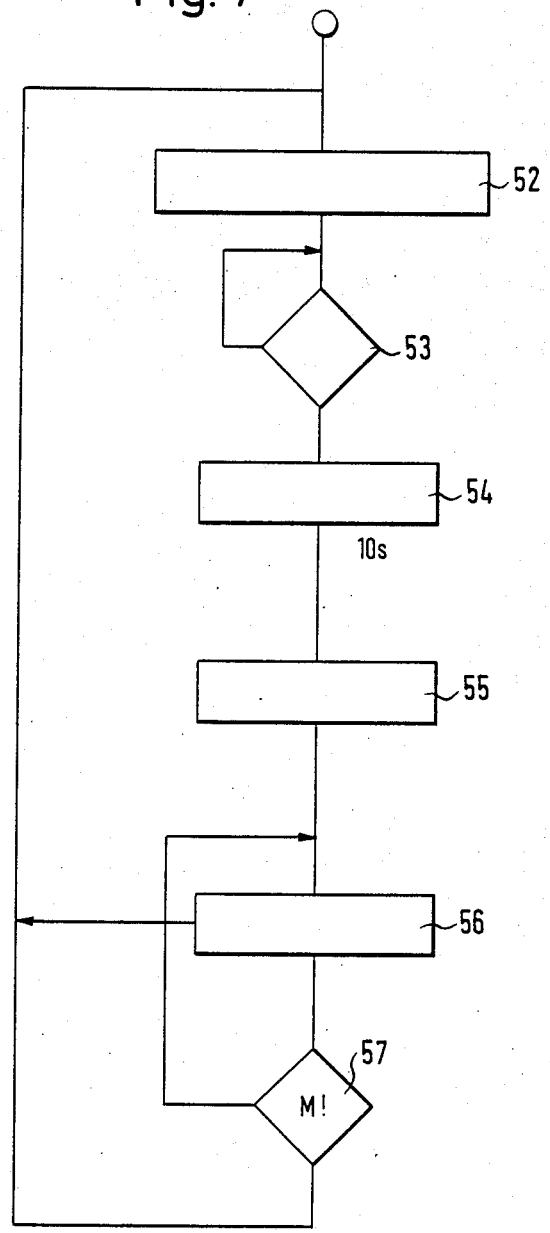
FIG. 7 a flow chart for the circuit according to FIG. 6.

According to FIG. 7, after starting the optical monitoring device, the scanning carriage 18 is moved to the left according to block 52. According to block 53, the microcomputer 42 decides whether the device has been started or not.

According to block 54 a switch-on delay mechanism of the optical monitoring device is started, which in the present case contains a 10-second switch-on delay. During this delay the warp knitting machine is switched on, so that a given length of the knitted article is moved in the take-off direction as a function of processing speed. Following the switch-on delay, the optical monitoring device is switched on. During the switch-on delay, any fault just rectified in the knitted article must be moved out of the viewing range of the scanning beam.

After actuation of the reference mode switch 49 of the mode circuit 48, the microcomputer 42 is switched to the reference mode as designated by block 55. In this case the scanning carriage is moved by the motor control circuit 51 and the motor 28 perpendicularly to the knitted article 16, whereupon the transmitted light beam scans the knitted article in the form of a line. Also scan data are stored as pattern data in the random access memory 45 in the course of scanning, controlled by the microprocessor 43. According to one variant, not shown, line scanning of the knitted article can take place repeatedly, whereupon subsequently the mean is taken for the scan data of the same line position. In this case the averaged line data are then filed in the random access memory.

The random access memory therefore stores the scan data which are produced in the reference mode in the course of movement of the transmitted light beam, and which are available later as reference data. On account of this reference mode, knitted articles which have any width or pattern or which are discontinuous can be scanned and later examined for faults.

After actuation of the operating mode switch 50 of the mode circuit 48, according to block 56 the operating mode is started. In the operating mode, the scanning carriage 18 constantly travels to and fro. The scan values or data produced in the process are compared as operating scan signals with the associated line position-dependent reference data. In the operating mode no data are recorded in the random access memory, but only the stored pattern data are read out for comparison purposes.

If the comparison of the operating scan signals with the reference signals for any given line position yields an inequality, then the motor is stopped as a fault has been detected.

According to another solution, this fault signalling does not take place until after a given number of successive line scans, on condition that inequality signals have been generated one after the other for the line position concerned.

In this way the susceptibility of the optical monitoring device to break down is reduced.

In block 57, the microprocessor 43 determines whether the motor 28 is running or not. If the motor 28 is running, the operating mode is repeated. In this way continued line scanning takes place until a given number of inequalities one after the other is detected for the same line position.

In FIG. 8 the components corresponding to the components of FIG. 1 are provided with the same reference numbers. To distinguish them, however, they bear indices. For clarity's sake, only some of the warp threads 1', 2', 3', 4' and 5' are shown. At a given distance from the knitted article 16' is located a CCD camera 58 with a CCD photocell array with 4096 photosensitive pixels. In the camera are also located an analog-to-digital converter and a serial output interface. At 59 is provided a glass fibre transmission line for the digital signals. The whole logic circuit for the CCD camera is provided with programmable digital units. According to FIG. 9, the glass fibre transmission line 59 leads to an analyser circuit 60 which contains a microcomputer 42'. The digital analyser circuit is firstly connected to the drive motor 28' and the angle coder 29', and secondly contains a connection with a display circuit 61. The knitted article 16' is scanned line by line by the CCD camera across its full width, the scanning line being marked 62. Beneath the knitted article 16' is located a lighting device consisting of fluorescent tubes 63, 64 and 65. Each fluorescent tube comprises at its end region a perpendicularly bent lighting arm. Adjacent arms of the fluorescent tubes touch each other. In this way across the full width of the knitted article there is produced a distribution of brightness which causes only a slight reduction of light at the points of contact between adjacent fluorescent tubes. This decrease in light current at the points of contact is not detected as a fault by the CCD camera. The mode of operation of the optical monitoring device according to FIGS. 8 and 9 is the same as that of the first practical example. This means that in a reference mode pattern data are stored in a random access memory and then in the subsequent operating mode used as reference signals for the scanned operating scan data.

Figure 10:
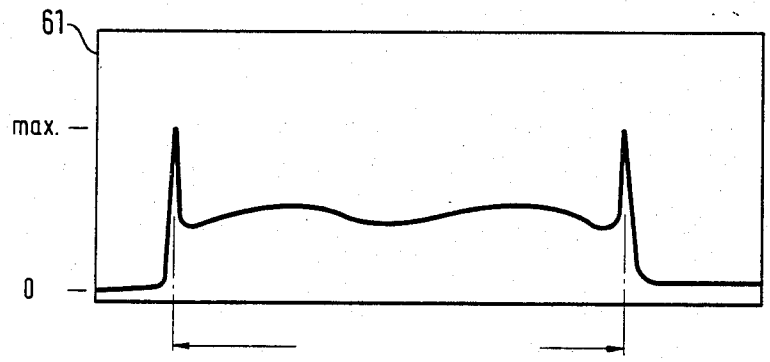
FIGS. 10 and 11 display of brightness curves across the width of the knitted article.
Figure 11:
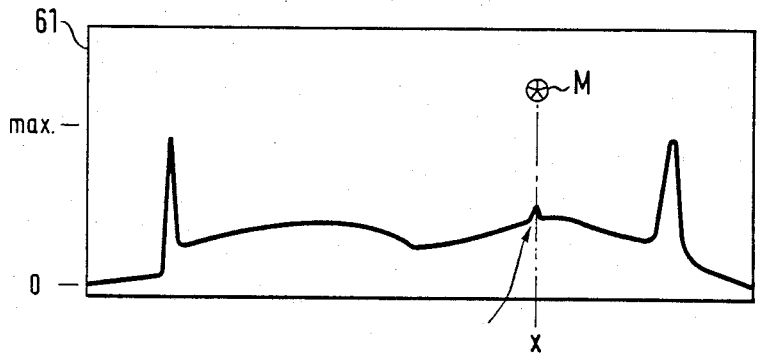

Any fault which arises is indicated by position in the indicator 61, which is constructed as a display unit. In FIGS. 10 and 11 are shown corresponding typical CCD camera pictures such as occur in the indicator 61.

FIG. 10 shows the reference mode and the corresponding brightness curve across the width of the knitted article. The brightness peaks occurring on the left and right in the indicator 61 signal the respective edges of the knitted article.

In FIG. 11, at point x can be seen a fault in the form of a small light peak. A fault of this kind is indicated as a marking M in the indicator 61.

What is claimed is:

1. Method for optically monitoring a knitted article for faults during the manufacture thereof in a knitwear processing machine, said knitwear processing machine including an optical scanner for scanning the width of the knitted article perpendicularly to the direction of take-off and, on detection of a fault in the knitted article, indicates such a fault and/or stops the knitwear processing machine, comprising:

scanning the knitted article line by line with the optical scanner and delivering scan signals generated by the optical scanner during such scanning to a digital processing circuit;

storing the scan signals in the digital processing circuit as pattern signals while in a reference mode; and in a subsequent operating mode during manufacture of a knitted article, scanning the knitted article line by line and comparing the scan signals generated by the optical scanner during the operating mode with the pattern signals which correspond in scan position thereto, thereby determining whether the scan signals generated during the operating mode match the corresponding pattern signals.

2. Method according to claim 1 including the step of generating a fault signal only when the scan signals generated driving the operating mode do not match the pattern signals for a given number of successive line scans.

3. Method according to claim 1 including stopping the knitwear processing machine when the scan signals generated during the operating mode do not match the corresponding pattern signals due to a fault in the knitted article, rectifying the fault, starting the knitwear processing machine, and recommencing scanning once the fault in the knitted article is moved out of range of the optical scanner.

4. An optical monitoring device for a knitwear processing machine comprising:

a light source for generating a beam;

a light detector;

means for mounting said light source and said light detector in stationary positions;

a scanning carriage movably mounted between said light source and said light detector, said scanning carriage being movable in a plane;

a 90° corner reflector including first and second partial reflectors and a bisecting line formed by said first and second partial reflectors, the bisecting line running parallel to the beam which is generated by the light source;

said first partial reflector facing towards said light source and being fully reflective;

said second partial reflector facing towards said light detector and being semitransparent, whereby transmitted light rays from said light source pass through said second partial reflector, and light rays reflected by a knitted article positioned in a plane parallel to the plane within which said scanning carriage is movable will be deflected by said second partial reflector wards said light detector.

5. Optical monitoring device according to claim 4 wherein the light source and the light detector are arranged at the respective ends of a light shaft and the scanning carriage is movable along the light shaft.

6. Optical monitoring device according to claim 5 wherein the scanning carriage is movable via transmission means by a drive motor along the light shaft and guided through the latter, and an angle pick-up is provided for determining the position of the scanning carriage.

7. Optical monitoring device according to claim 4 wherein the light source is a semiconductor laser with a collimator lens.

8. Optical monitoring device according to claim 7 wherein the light detector comprises two or more photocells which are arranged vertically one above the other.

9. Optical monitoring device according to claim 8 wherein a pair of photocells is provided, one photocell of which is connected to a regulating circuit for regulating the laser output of the semiconductor laser.

10. Optical monitoring device according to claim 8, wherein the individual photocells are connected to an integrator circuit in which difference signals from the signals of the respectively adjacent photocells are integrated in the course of scanning.

11. Optical monitoring device according to claim 4 including a knitted article positioned beneath the 90° corner reflector, wherein in the region of the edge of the 90° corner reflector on the side facing towards the light detector is provided a lens assembly whose focal length is approximately equal to the distance between the 90° corner reflector and the knitted article, whereby the size of the image of the knitted article on the light detector is substantially independent of the position of the scanning carriage.

12. Optical monitoring device according to claim 4 wherein the light detector is connected by an analog-to-digital converter to a digital processing circuit comprising a control circuit and a random access memory, the digital processing circuit being switchable between a reference mode and an operating mode, scan signals generated by the analog-to-digital converter being storable in the memory as pattern data in the reference mode, and in the operating mode the pattern data can be read out from the memory as reference data and compared with corresponding operating scan data which are dependent on the position of the scanning carriage.

13. Optical monitoring device according to claim 11, wherein the digital processing circuit comprises a microcomputer which, apart from the analog-to-digital converter of the light detector, is connected to the angle pick-up and a motor control means, and the pattern data can be recorded in the memory only in the reference mode.

14. A knitwear processing machine comprising:

means for knitting a knitted article;

means for optically monitoring a knitted article for faults during the manufacture thereof, said means for optically monitoring including means for scanning the width of a knitted article line by line perpendicularly to a direction of take-off of the knitted article, said means for scanning including means for generating scan signals depending upon the physical characteristics of the knitted article being scanned;

a digital processing circuit;

means for delivering scan signals generated by said means for scanning to said digital processing circuit, said digital processing circuit being capable of storing the scan signals as pattern signals while in a reference mode; and means for comparing scan signals generated by said means for scanning while in an operating mode with said pattern signals for corresponding scan positions, thereby determining whether the scan signals generated during the operating mode match the corresponding pattern signals.

15. Method according to claim 1 wherein in the reference mode several lines are scanned, and the mean of corresponding pattern signals of several lines is taken, as seen in the take-off direction of the knitted article.

16. A knitwear processing machine as described in claim 14 including a light detector, a light source assembly positioned beneath a plane of take-off of a knitted article and extending across the full width of a knitted article within the machine, a camera positioned above the plane of take-off of a knitted article, said camera including a digital image converter device, the digital processing circuit being switchable between the reference mode and the operating mode.

17. A knitwear processing machine as described in claim 16 wherein the light source assembly includes a plurality of adjoining fluorescent tubes, each of the fluorescent tubes including end portions which are bent by at least ninety degrees relative to the remaining portions thereof.

18. A knitwear processing machine as described in claim 14 including knitting tools for knitting a knitted article, said means for scanning being positioned to scan a knitted article in the immediate vicinity of the knitting tools.

19. A knitwear processing machine as described in claim 14 including a light source for generating a beam, a light detector, means for mounting said light source and said light detector in stationary positions above a plane of take-off of a knitted article within the machine, a scanning carriage movably mounted between said light source and said light detector, and reflecting means mounted to said scanning carriage for directing a beam of light from said light source onto a knitted article and for directing a beam of reflected light from a knitted article to said light detector.

20. A knitwear processing machine as described in claim 19 including a lens assembly positioned between said reflecting means and said light detector, said lens assembly having a focal length approximately equal to the distance between said reflecting means and the plane of take-off of a knitted article.

* * * * *